US005330818A

United States Patent [19]

Langley

[11] Patent Number: 5,330,818

[45] Date of Patent: Jul. 19, 1994

[54] REINFORCEMENT PREFORM OF KNITTED FIBRES

[75] Inventor: Kenneth R. Langley, Gloucestershire, England

[73] Assignee: Rolls-Royce plc, London, England

[21] Appl. No.: 810,158

[22] Filed: Dec. 19, 1991

[30] Foreign Application Priority Data

Dec. 20, 1990 [GB] United Kingdom ..... 9027585

[51] Int. Cl.[5] ..... D04B 1/00; B32B 3/10; B32B 3/06; B29B 7/00

[52] U.S. Cl. ..... 428/102; 66/169 R; 66/170; 428/133; 428/136; 428/245; 428/253; 428/542.8

[58] Field of Search ..... 428/542.8, 133, 136, 428/245, 253, 102; 244/56, 35 R, 123, 124; 66/169 R, 196, 170, 197, 200; 416/223 R, 223 A, 230 R, 230 B, 241 R, 241 B

[56] References Cited

U.S. PATENT DOCUMENTS

| | | | |
|---|---|---|---|
| 204,441 | 6/1878 | Marshall | 428/542.8 |
| 781,082 | 1/1905 | Morris | 229/116 |
| 1,597,757 | 8/1926 | Berger | 428/542.8 |
| 2,107,946 | 2/1938 | Inman | 428/133 |
| 2,615,564 | 10/1952 | Post | 206/446 |
| 3,319,866 | 5/1967 | Kitchell | 428/542.8 |
| 3,846,218 | 11/1974 | Wootten | 428/136 |
| 4,022,035 | 5/1977 | Lonati | 66/177 |
| 4,664,961 | 5/1987 | Vees et al. | 428/542.8 |

FOREIGN PATENT DOCUMENTS

| | | |
|---|---|---|
| 1304018 | 1/1973 | United Kingdom . |
| 1571102 | 7/1980 | United Kingdom . |
| 2189517 | 10/1987 | United Kingdom . |

OTHER PUBLICATIONS

Sharkey, J., "The production of aircraft structures using resin transfer moulding with Courtaulds knitted preform techology", I. Mech. E. Aerotech '89, Aerospace Manufacturing Technologies, Oct. 31, 1989.

*Primary Examiner*—James D. Withers
*Attorney, Agent, or Firm*—Oliff & Berridge

[57] ABSTRACT

Reinforcement preform of knitted fibers for a carbon or the like component such as an airfoil guide vane. A junction between adjacent sections of the finished article of the preform is formed with a buttonhole. In assembly, the reinforcement for one of the sections is passed through the buttonhole. In this way stresses can be better transmitted to a base section with reduced risk of tearing or delamination.

7 Claims, 2 Drawing Sheets

REINFORCEMENT PREFORM OF KNITTED FIBRES

FIELD OF THE INVENTION

The invention relates to a reinforcement preform of knitted fibers for a reinforced article.

In particular the present invention concerns the assembling of a one piece knitted fiber reinforcement preform for maximum strength and durability prior to its use in a transfer molding process.

BACKGROUND OF THE INVENTION

Conventional techniques of manufacturing carbon and glass fiber reinforced articles have used labor intensive wet layup or prepreg techniques using layers of woven cloth or matt. In attempts to speed up the process the reinforcing fibers have been chopped up and mixed with one of the components of a catalyst-cured resin system thereby allowing the fibers to be injected into a molding die. The latter process while being quick and easy to handle suffers a fundamental drawback. The random orientation of the reinforcing fibers produces a cast structure of uniform strength in all directions but which is of inadequate strength in areas of high stress. While the layup and prepreg techniques can be used to provide the necessary strength, results may vary and these are inefficient and unsuitable for economic production.

Reinforcement preforms can be knitted in the same way as socks and gloves. The basic preform is then folded and tacked or stitched together before being loaded into a die to be impregnated with injected resin. This arrangement still provides a component in which the reinforcement lacks sufficient strength in regions of lateral stress, such as at a junction between two orthogonal sections. This invention seeks to overcome this drawback.

SUMMARY OF THE INVENTION

According to the present invention in its broadest aspect, a reinforcing preform is knitted with a buttonhole located at a junction between adjacent sections of the finished article. In assembling the preform for maximum stress capability at the junction at least one section of reinforcing preform is passed through the buttonhole to provide reinforcement in an adjacent section.

BRIEF DESCRIPTION OF THE DRAWINGS

The invention and how it may be carried into practice will now be described in greater detail with particular reference to the embodiment illustrated in the accompanying drawings in which.

DESCRIPTION OF THE PREFERRED EMBODIMENT

Figure 1:
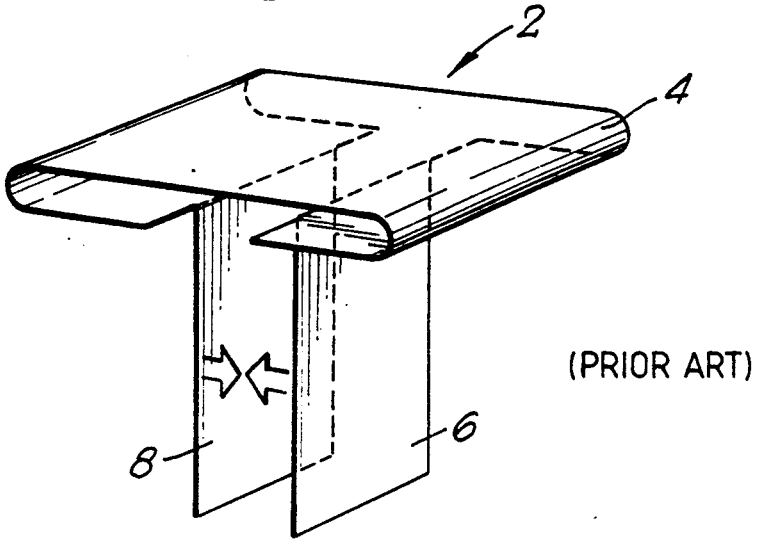
FIG. 1 shows in schematic form a known method of assembling a one-piece knitted fiber reinforcement preform for a ceramic nozzle guide vane in a gas turbine engine.

Referring now to FIG. 1, a reinforcement preform 2 for a ceramic airfoil guide vane comprises a length of knitted silicon carbide fiber fabric folded in the shape of a "T". The fabric preferably varies in width so that it has a broad center section 4 flanked by narrower side sections 6,8. In assembly, the center section 4 is folded back onto itself at two fold lines spaced equidistant from a center line so that the edges of the broader section meet on the center line. These form the vane platform or base. The side sections are then bent upwards at right angles to the platform to form reinforcement for the airfoil portion.

The edges of the reinforcement piece are then stitched together before it is placed in a mold for impregnation. At least the edges 10,12 of the side sections are stitched together. However, the reinforcing fabric lacks inherent stiffness and stitching does not appreciably impart rigidity although it helps the finished piece retain its shape.

The preform is loaded into a mold cavity for impregnation with, for example, a thermosetting resin. The resin is then burned off to leave a char on the surface of the preform fibers. The preform retains its stiffness and holds its shape while the carbon matrix is impregnated into the structure in a suitable process, for example, vapor deposition..

It has been found however, that in use, stress concentrations around the junction of the airfoil section with the platform are sufficient to cause structural fatigue in the reinforcement matrix. Although the bulk of the component material is unaffected the localized failure is sufficient to curtail useful component life.

The present invention seeks to overcome these drawbacks in the manner illustrated in the remaining drawings. Basically the reinforcing piece is folded in a way which increases its inherent strength in the region of the airfoil platform junction so as to better absorb the stress encountered in use.

Figure 2:
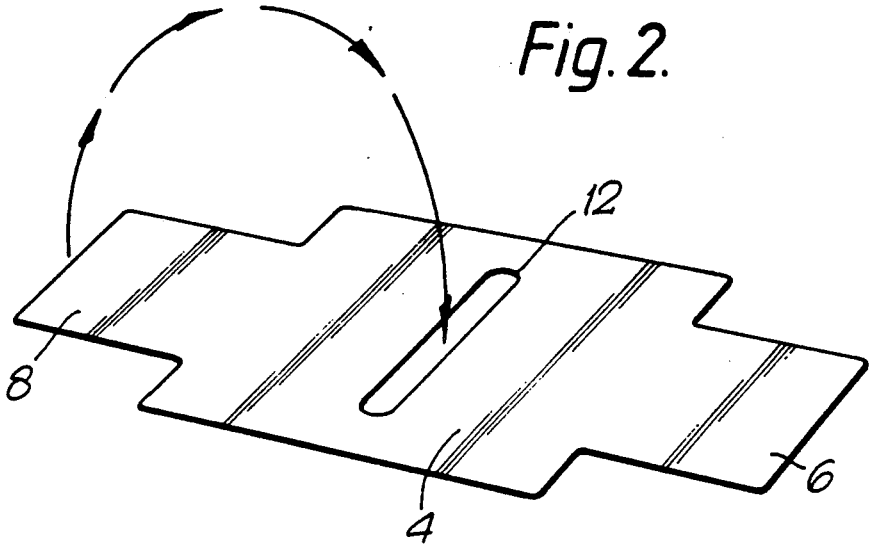
FIG. 2 shows opened-out a reinforcement preform incorporating the invention.

The center section 4 of the preform as shown in FIG. 2 is formed with a "button hole" or slot 12 on the center line of the middle section of the piece. Then as further shown in FIG. 3, the side sections 6,8 instead of being folded under the platform reinforcement are folded over it and then passed through the slot 12. As before, the sections 6 and 8 are then stitched together along their abutting edges to comprise the airfoil reinforcement. By this means, stresses in the airfoil section reinforcement will be better transmitted to the base section with reduced risk of tearing or delamination in the vicinity of their mutual junction.

Under certain load conditions a symmetrical assembly described above may not prove ideal. If the vane is subject to a substantially unidirectional transverse loading, the reinforcement layers on the side of the force are subject to a tensile force, and on the other side, to a compressive force. If the layer on the compressive side has passed through slot 12, the force will tend to separate the double reinforcement in the adjacent platform section. The solution is to fold the platform reinforcement sections in opposite directions at opposite ends of the platform so that the section on the compressive side is not passed through slot 12. Thus only one section of reinforcement passes through the button hole slot.

The slot 12 or "button hole" is preferably formed by knitting in the first instance to preserve the integrity of the reinforcing fibers. A knitted margin surrounding the slot 12 defines a button hole. In that way the fibers of the fabric, i.e., the threads of the knitted fiber, remain capable of transmitting tensile stress. Interruption of fiber continuity as would be caused by a cut and stitched slot made after the reinforcing fabric was knitted, would seriously reduce the inherent strength of the preform.

Figure 4A:
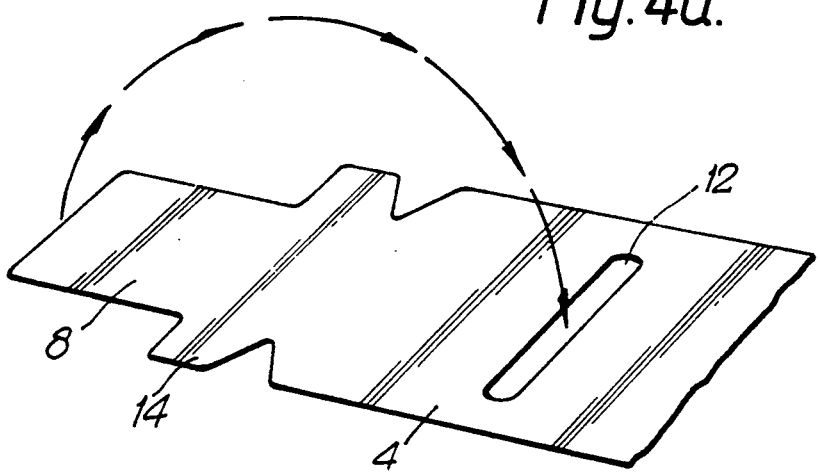
FIGS. 4*a* and 4*b* show fragmentary views of an article similar to FIG. 3 illustrating how a further structural feature might be incorporated.
Figure 4B:
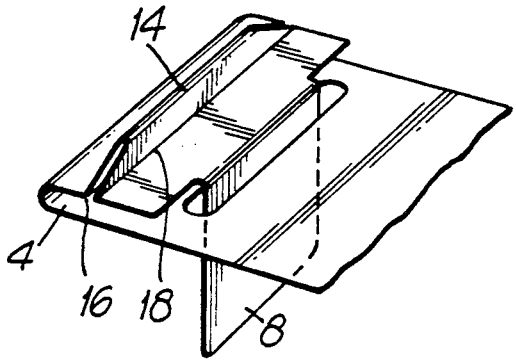
Figure 3:
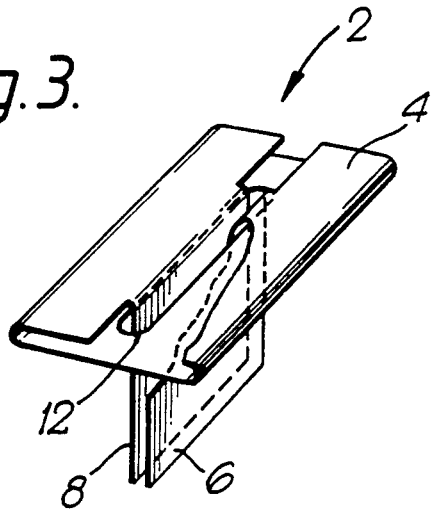
FIG. 3 shows the preform of FIG. 2 folded in preparation for impregnation.

FIGS. 4*a* and 4*b* show the same basic component as FIG. 3 with the addition of an axial rib 14 formed on one face of the platform opposite the airfoil. An additional section is knitted into the basic preform piece; by increasing its length and varying the width as necessary. This is shown in FIG. 4*a*. During the assembly/folding stage, equivalent to FIG. 3, as shown in FIG. 4*b* the extra section is raised from the middle platform section to form the axially extending rib. This may be stitched on either side on lines 16,18 to help it retain shape prior to the resin loading step described above.

The rib or a plurality of such ribs may be formed in the place of the vane, that is the airfoil section. The ribs may be connected with axial flanges.

I claim:

1. A one-piece knitted fiber preform for a reinforced article having two adjacent sections in a "T" shape, said preform comprising:

a first preform section formed from a central portion of a single, continuous knitted fabric, the first preform section including an elongate opening extending across a width of the knitted fabric; and a second preform section being formed from the knitted fabric at a first end of the first preform section, the second preform section being passed through said elongate opening and being substantially perpendicular to the first preform section, the first and second preform section forming a junction which is further reinforced to withstand stress.

2. The preform as claimed in claim 1, wherein a perimeter of the elongate opening is reinforced with stitching.

3. The preform as claimed in claim 1, wherein the second preform section is narrower in width than the first preform section so that the elongate opening is of sufficient elongation to accommodate the width of the second preform section.

4. The preform as claimed in claim 1, wherein the elongate opening is defined by a knitted margin.

5. The preform as claimed in claim 1, wherein the elongate opening is a buttonhole.

6. The preform as claimed in claim 1 further comprising a third preform section being formed from the knitted fabric at a second end of the first preform section and being opposite the second preform section, the third preform section passing through the elongate opening.

7. The preform as claimed in claim 6, wherein the second and third preform sections are stitched together.

* * * * *